United States Patent [19]

Stucker

[11] 4,024,633

[45] May 24, 1977

[54] SIMPLIFIED SAFETY GUARD FOR A CLOTH CUTTING MACHINE

[75] Inventor: Robert G. Stucker, Sunman, Ind.

[73] Assignee: The Wolf Machine Company, Cincinnati, Ohio

[22] Filed: Nov. 28, 1975

[21] Appl. No.: 635,579

[52] U.S. Cl. ..... 30/273

[51] Int. Cl.[2] ..... B26B 25/00; B26B 29/00

[58] Field of Search ..... 30/273, 276, 373, 391; 83/478, 546

[56] References Cited

UNITED STATES PATENTS

| | | | |
|---|---|---|---|
| 2,839,103 | 6/1958 | Prince | 30/391 X |
| 2,916,062 | 12/1959 | Clauson | 30/373 |
| 3,812,584 | 5/1974 | Peter | 30/391 |

FOREIGN PATENTS OR APPLICATIONS

| | | | |
|---|---|---|---|
| 532,879 | 2/1941 | United Kingdom | 30/273 |

*Primary Examiner*—Al Lawrence Smith
*Assistant Examiner*—J. C. Peters
*Attorney, Agent, or Firm*—Wood, Herron & Evans

[57] ABSTRACT

A simplified safety guard for a cloth cutting machine of the vertically oriented circular blade type. The simplified guard includes a fixed section mounted to the machine that permanently guards substantially three-quarters of the blade's periphery, and a movable section pivotally mounted to the fixed section that guards the remainder of the blade's periphery when the blade is not engaged in a cutting operation with a cloth stack. The movable section is pivotally mounted to the fixed section in the 12 o'clock to 3 o'clock quadrant of the blade relative to the machine's right-to-left direction of travel. The movable section is fabricated of a transparent material to permit viewing of the cutting pattern on the cloth stack, is provided with a U-shaped nose adapted to embrace the edge of the blade, and includes a thumb lip disposed adjacent the machine's handle for opening the movable section as desired by the operator, preparatory to cutting the cloth stack, all in a one-piece structural member. The movable section is especially configured along its top edge to permit engagement of a blade sharpener device with the circular blade in a sharpening relationship whether the safety guard is opened or closed. The safety guard is structured so that same can be removed from the cloth cutting machine as a single unit simply by unscrewing one thumb screw, thereby permitting simple and easy changing of the machine's circular cutting blade when required.

10 Claims, 5 Drawing Figures

SIMPLIFIED SAFETY GUARD FOR A CLOTH CUTTING MACHINE

This invention relates to cloth cutting machines. More particularly, this invention relates to an improved safety guard for a particular type of cloth cutting machine.

One basic type of cloth cutting machine is that which makes use of a circular blade, the circular blade being oriented in a vertical plane and being adapted to rotate at high speeds. The circular blade is driven by a motor fixed to the machine. The blade and motor are carried on a standard, the standard including a relatively flat base adapted (such as by needle rollers or the like) to roll over a cloth cutting table. Suitable handles are provided on a machine for gripping by an operator, these handles allowing manual guidance of the cloth cutting machine as it is pushed along the cloth cutting table.

In use, this known type of vertically oriented, circular blade cloth cutting machine is adapted to cut all types of fabrics. Generally speaking, the fabric is laid up or piled into a cloth stack of multiple layers. Such a stack of cloth may be, e.g., 3 to 5 inches in thickness. A cutting pattern outline is traced on the top fabric ply, that outline being, e.g., of a raincoat panel or a suit coat panel or a pants leg panel or the like. The cloth stack, i.e., the multiple fabric layers, is then cut by means of the cloth cutting machine, the vertically oriented circular blade being guided along the cutting pattern defined on the top fabric layer as the machine is manually pushed through the cloth stack.

Such a vertically oriented, circular blade cloth cutting machine is usually provided with a sharpener device adapted to reciprocate into and out of sharpening engagement with the blade's periphery. The sharpener device allows sharpening of the blade when desired by the operator by moving the device into contact with the blade's cutting edge while the blade is rotating. The sharpener device is retracted and retained out of engagement with the blade's cutting edge when not in use.

While such cloth cutting machines are quite efficient in cutting stacks, i.e., multiple layers, of cloth into garment pieces, it will be understood that the circular blade's periphery must be exposed to the fabric layers to accomplish such a cutting function. The periphery of such a circular blade must be quite sharp indeed, and the blade is rotated at a relatively high rpm, in order to perform efficiently the cutting function. It is, of course, the front segment of the circular blade that is presented into cutting contact with the cloth stack as the machine is manually pushed through the stack. The large, exposed front segment of the circular blade, it will be readily understood, may well provide potential safety hazards to the operator of the machine especially when the machine is disengaged from a cutting attitude with the cloth stack.

Safety guards for cloth cutting machines of the vertically oriented circular blade type are known to the prior art. One example of such a safety guard structure is illustrated in U.S. Pat. No. 3,812,584 assigned to the assignee of this application. The safety guard structure illustrated and described in that patent, however, is complex in structural component makeup relative to the improved safety guard structure of this invention. In other words, and in connection with the safety guard shown in U.S. Pat. No. 3,812,584, same is made up of multiple component parts which makes the maintenance and operation of same more difficult relative to the improved safety guard of this invention, and which makes same uneconomical to manufacture relative to the improved safety guard of this invention.

Therefore, it has been one objective of this invention to provide an improved and simplified safety guard for a cloth cutting machine of the vertically oriented, circular blade type, that safety guard being adapted to move between a closed position where the circular blade is substantially fully enclosed and a retracted or open position where cutting of a cloth stack can be accomplished.

It has been a further objective of this invention to provide an improved and simplified safety guard for a cloth cutting machine of the vertically oriented, circular blade type, that safety guard requiring manual activation by an operator before the machine can be used and being failsafe in structure so that same will always be closed except when the machine is operationally engaged with a cloth stack.

It has been still another objective of this invention to provide an improved and simplified safety guard for a cloth cutting machine of the vertically oriented, circular blade type, that safety guard being easily removable as a unit from the machine's other structure so as to permit easy replacement of the circular blade.

It has been yet another objective of this invention to provide an improved and simplified safety guard for a cloth cutting machine of the vertically oriented, circular blade type, that safety guard being adapted to protect substantially the entire periphery of the circular blade when the guard is closed, as well as being adapted to allow a blade sharpener device to sharpen the blade when the safety guard is opened or closed as desired by an operator.

In accomplishing the objectives of this invention there is provided a simplified safety guard that includes a fixed section mounted to the machine that permanently guards substantially three-quarters of the blade's periphery, and a movable section pivotally mounted to the fixed section that guards the remainder of the blade's periphery when the blade is not engaged in a cutting operation with a cloth stack. The movable section is pivotally mounted to the fixed section in the 12 o'clock to 3 o'clock quadrant of the blade relative to the machine's right-to-left direction of travel. The movable section is fabricated of a transparent material to permit viewing of the cutting pattern on the cloth stack, is provided with a U-shaped nose adapted to embrace the edge of the blade, and includes a thumb lip disposed adjacent the machine's handle for opening the movable section as desired by the operator, preparatory to cutting the cloth stack, all in a one-piece structural member. The movable section is especially configured along its top edge to permit engagement of a blade sharpener device with the circular blade in a sharpening relationship whether the safety guard is opened or closed. The safety guard is structured so that same can be removed from the cloth cutting machine as a single unit simply by unscrewing one thumb screw, thereby permitting simple and easy changing of the machine's circular cutting blade when required.

Other objectives and advantages of this invention will be more apparent from the following detailed description taken in conjunction with the drawings in which.

Figure 1:
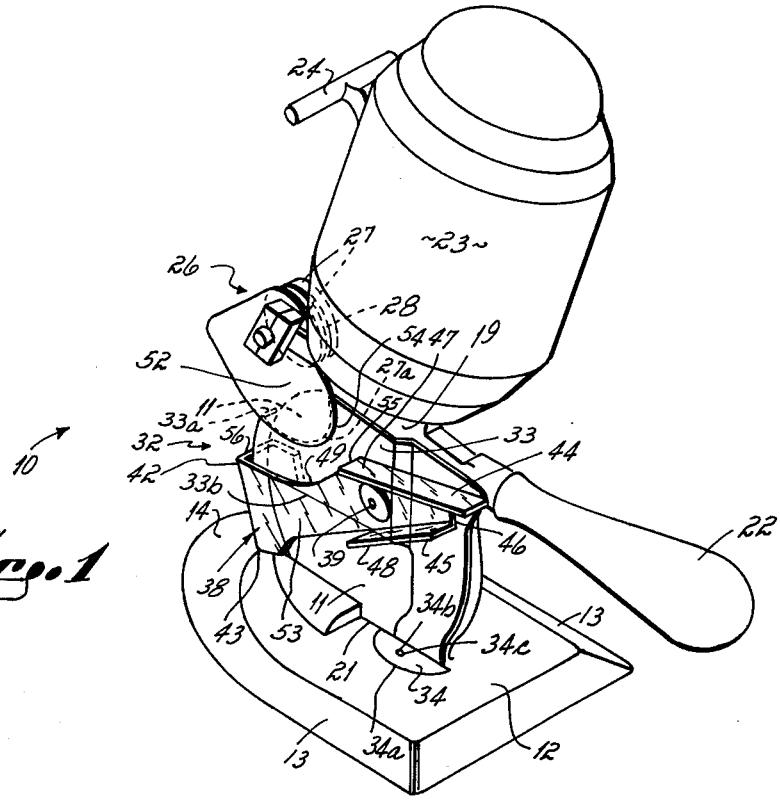
FIG. 1 is a perspective view illustrating the structural components of the improved and simplified safety guard for a cloth cutting machine of this invention.

A cloth cutting machine 10 of the vertically oriented circular blade 11 type is particularly illustrated in FIG. 1. As shown in that FIGURE, the cloth cutting machine 10 includes a base 12 having tapered or canted side edges 13, those side edges (particularly at the nose portion 14) allowing the base to easily slide under a cloth stack 15 of multiple fabric layers 16 for cutting purposes, see FIG. 3. The base 12 carries a plurality of needle rollers 17 that allows the machine 10 to roll easily over the surface of a cutting table 18 on which the cloth stack 15 is located. The height H of the cloth stack 15 shown is the maximum height that can be cut by the machine shown, i.e., the stack's height H cannot be greater than the radius of the circular blade 11.

The cloth cutting machine 10 as noted, includes the circular saw blade 11 that is oriented in a vertical plane, that plane more or less bisecting the nose portion 14 of the base 12. The circular blade 11 is supported on a standard 19 that is cast integral with the base 12. The blade 11 is rotatably fixed to the standard such that it is partially enclosed at a bottom segment 20 by being received in the base's groove 21. The machine's circular blade may be viewed as a clock face, and it will be understood that when referring to o'clock positions on the clock face that it is assumed the machine will be oriented to traverse a path from right to left in cutting a cloth stack; this spatial relationship or viewpoint holds true throughout when describing the improved safety guard of this invention.

The standard 19 mounts a primary handle 22 that extends rearwardly of the base 12 in a substantially horizontal direction. A motor drive mechanism 23 is mounted to the top of the standard 19 and is interconnected by a drive gear train (not shown) with the circular blade 11, that mechanism 23 providing motive means by which the circular blade 11 is rotated at relatively high rpms for cutting the layers of cloth 16. A secondary handle 24 is mounted at the forehead of the motor drive means 23, thereby providing a handle 22 and 24 for each of an operator's hands so that the circular blade 11 can be adequately guided along a pattern (not shown) drawn on the top fabric layer **16*a* of the cloth stack 15. That is, the handles 22, 24 provide means for an operator to grip, and to orient as desired, the machine 10 when cutting a cloth stack 15. In use, the cloth cutting machine 10 is gripped by handle 22 with one hand, and by handle 24 with the other hand, by an operator while the blade 11 is rotating rapidly as driven by motor drive means 23. The operator then guides the cloth cutting machine 10 about the pattern (not shown) on the top fabric layer 16*a* of the cloth stack 15 while rolling the machine (on rollers 17) across cutting table 18. As viewed in FIGS. 2–4, the machine 10 will traverse a travel path 25 to engage and cut the cloth stack 15.**

A sharpener device 26, which includes circular shapening stones 27 facing one another in mirror relation so as to define a groove 28 therebetween, is fixed in pivotal relation about axis 29 to the machine's standard 19. The sharpener device 26 is mounted so that the groove 28 is in the same vertical plane as blade 11. The sharpener device 26 is continually biased toward its home or nonsharpening position (shown in FIGS. 1 and 2) by a spring (not shown). In use, and while the circular blade 11 is rotating, an operator depresses the sharpener device 26 by pushing downward on thumb stud 30, thereby pivoting the device about axis 29 so as to locate the blade's peripheral edge 31 in grinding contact with the sharpening stones 27 within groove 28. This, of course, sharpens the blade's peripheral edge 31. After sufficient sharpening time has elapsed, the sharpener device 26 is simply allowed to return to home position by releasing the thumb stud 30. As will appear from the detailed description below, the machine 10 may be either disengaged from or engaged in cutting contact with the cloth stack 15 while the blade 11 is being sharpened.

Figure 4:
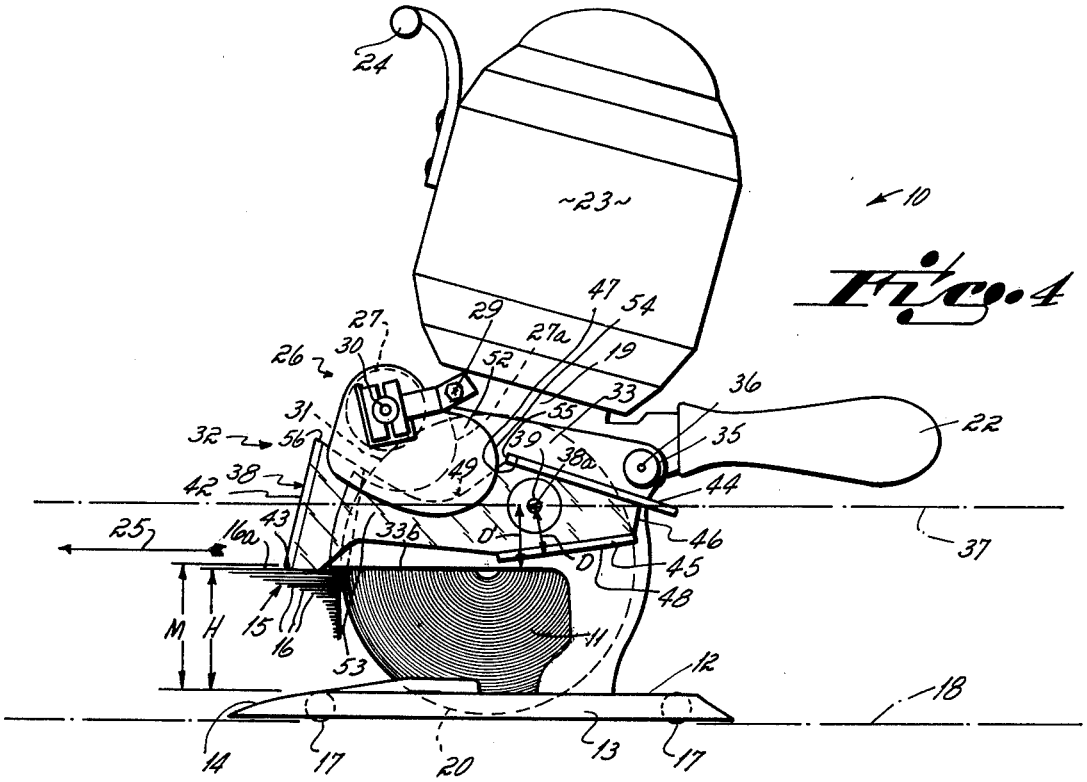
FIG. 4 is a view similar to FIG. 3 but with the blade sharpener device in sharpening contact with the circular blade.
Figure 2:
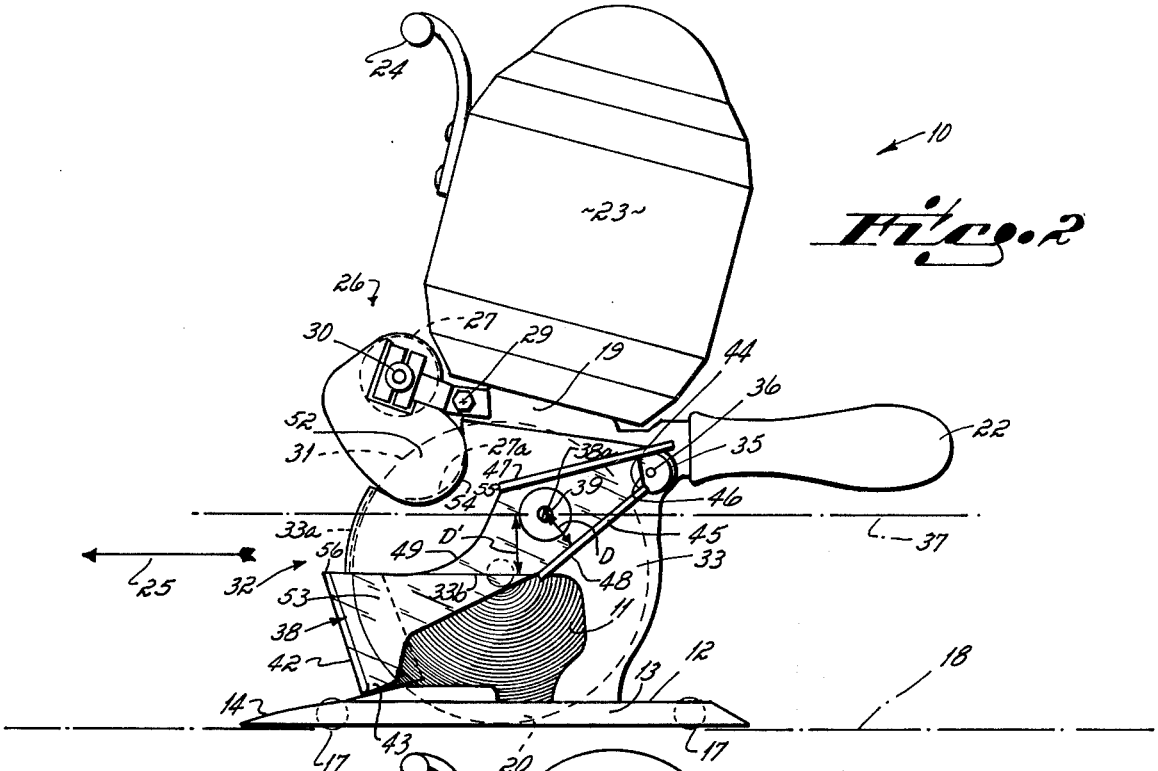
FIG. 2 is a side elevational view illustrating the safety guard in the fully closed position, the blade sharpener device being retracted out of sharpening contact with the circular blade.
Figure 3:
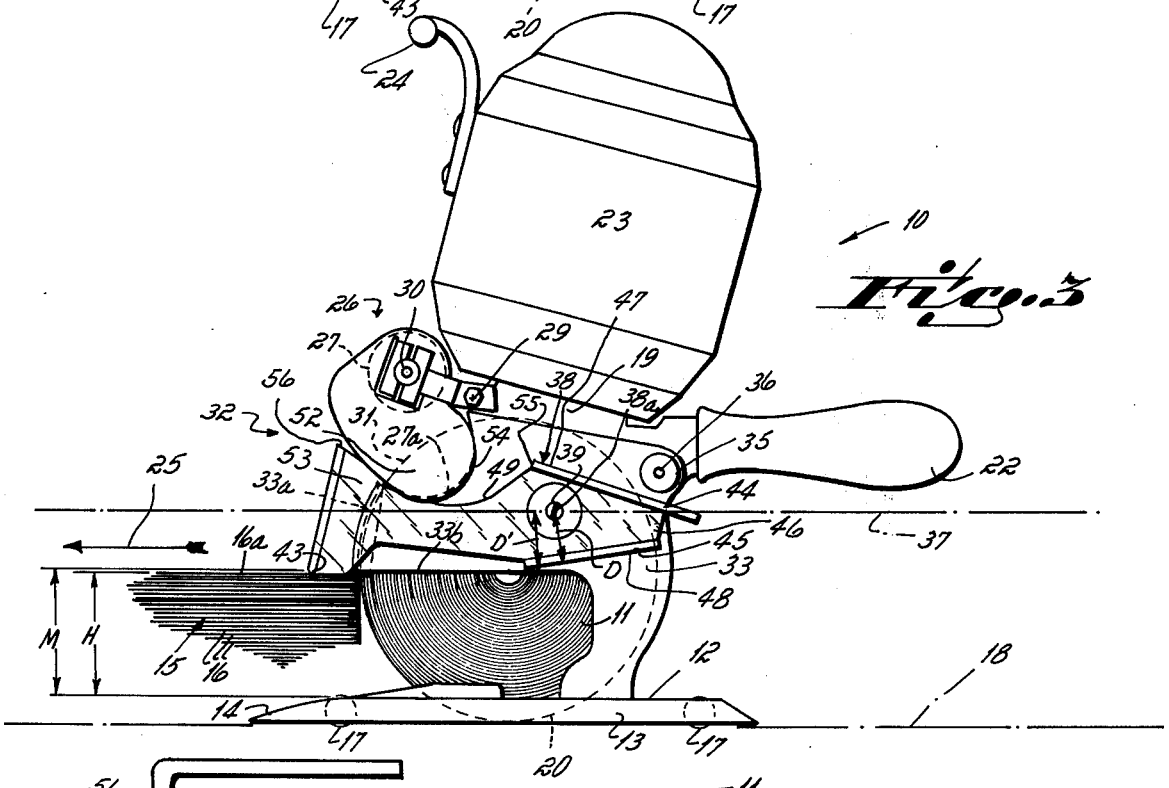
FIG. 3 is a view similar to FIG. 2 illustrating the safety guard in the fully opened position, the blade sharpener device also being retracted.

As viewed from side elevation in the FIGURES, and as previously mentioned, the circular blade 11 may be thought of as a face of a clock. In this regard, and when the machine 10 is oriented to traverse a travel path 25 from right to left as shown in FIGS. 2–4, it is to be noted that the motor drive means 23 is fixed to the standard 19, and extends radially upward therefrom, at about the 1 o'clock position. Also, the main handle 22 extends rearwardly of the circular blade 11 in a substantially horizontal attitude from about the 1 o'clock position. Further, the sharpening stones 27 are pivotally fixed to the standard 19 in a manner that allows same to pivot into and out of contact with the circular blade 11 at about the 11 o'clock position.

The various structural elements of the simplified and improved safety guard 32 of this invention are illustrated in perspective in FIG. 1. As shown in that FIGURE, the safety guard 32 of this invention includes a fixed section 33 adapted to be mounted upon the machine's standard 19. The fixed section 33 includes a foot 34 adapted to be received in a close tolerance fit within well **34*a* defined in the machine's base; the foot 34 is located within the well 34*a* by a locator pin 34*b* fixed to the base that cooperates with a hole 34*c* defined in the foot. The fixed section 33 is bolted by a thumb screw 35 or the like to standard 19 in threaded hole 36. The fixed section 33 totally encloses the rear segment of the circular blade 11 when in mounted relation with the standard 19 so that an operator's hand cannot engage the rear half of the blade (as measured clockwise from about the 12 o'clock position through the 3 o'clock position to the 6 o'clock position). The front or forehead portion of the fixed section 33 (which portion extends from the 12 o'clock position to the 9 o'clock position) is provided with notch 27*a* in that front portion's peripheral edge adjacent grinding wheels 27. That part of the forehead's peripheral edge beyond the notch 27*a* is provided with a guard lip 33*a* that extends over the blade's edge 31, the lip extending between about the 9 o'clock and 10 o'clock positions, see FIGS. 2 and 4. That is, the guard lip 33*a* does not totally enclose the blade's peripheral edge 31** but provides an overlapping flange of sufficient width so that contact of an operator's hand in an accidental manner with the blade's edge is substantially impossible. Note that the botto* edge 33*b* of the fixed section's front portion is horizontal and lies in an imaginary diameter line 37 of the circular blade that is parallel to the machine's base 12 and table 18. Thus, the fixed section 33, by virtue of the forehead portion's lip 33*a* and horizontal bottom edge 33*b*, defines the maximum height H cloth stack 15 which can be cut by the machine 10 during operation thereof.

Figure 5:
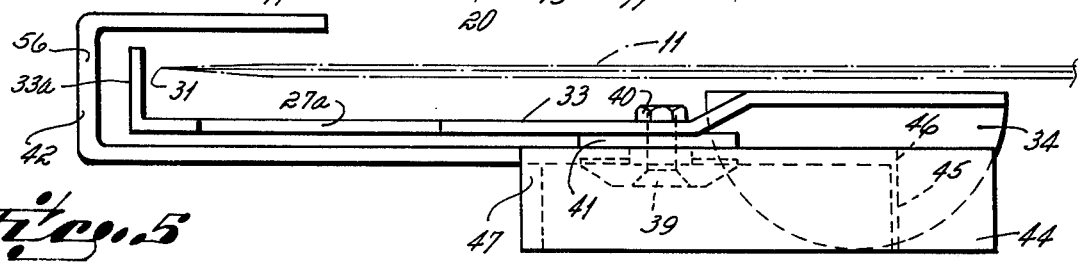
FIG. 5 is a top view illustrating the safety guard apart from the cloth cutting machine.

The generally plate-like movable section 38 of the safety guard is pivotally mounted on axis 38*a* to the fixed section 33 above the imaginary diameter line 37 drawn through the center of the blade 11 and parallel to the machine's base 12 and table 18. The movable section 38 is sized to extend from the forward end of the fixed section 33 to a location adjacent the handle 22. Preferably, the movable section 38 is pivotally mounted in the rear upper quadrant of the fixed section relative to the travel path 25 of the machine 10 over the cloth cutting table 18, i.e., within the 12 o'clock to 3 o'clock quadrant of the fixed section. This pivotal interconnection of the movable section 38 with the fixed section 33 is accomplished by a bolt 39 and nut 40 with the movable section being spaced from the fixed section by a washer 41, see FIG. 5.

The guard's movable section 38 is provided with a U-shaped head 42 at its front or lead end, the U-shaped head being structured so as to wrap around the cutting edge 31 of the circular blade 11 when the movable section is in the rest or home position, and being sized to cover the blade's front lower quadrant when the movable section is in the home position as illustrated in FIGS. 2 and 4. Such prevents inadvertent contact of an operator's fingers with the blade's front lower quadrant if the circular blade 11 is left running while the machine 10 is not engaged with a stack 15 of cloth. The U-shaped head 42 is also provided with a rounded chin 43 on the bottom edge thereof, the rounded chin being adapted to ride on top the cloth stack 15, thereby permitting the movable section to ride over that cloth stack without generating wrinkles in those pieces of cloth toward the top of the cloth stack.

The movable section 37 also includes a linear upper lip 44 and linear lower lip 45, both lips extending outwardly away from the circular blade as is particularly illustrated in FIG. 4. The upper lip 44 extends from the rear end 46 of the movable section to approximately the center of the circular blade 11 along the top edge of the movable section, thereby defining a platform that may be pushed down on by an operator's thumb to open the guard 32 while the operator's hand is grasping handle 22. In other words, the upper lip 44 of the movable section 38 extends rearwardly toward handle 22 a sufficient distance from the pivot mounting point 38*a* so that the operator can easily open the movable section by use of thumb motion, while grasping the machine's handle with the rest of his hand. The lower lip 45 provides structural rigidity to the movable section 38, and is also oriented so that same defines the bottom edge 48 of the movable section when the guard 32 is full open as shown in FIG. 3. The lower lip 45 structure is so positioned, relative to the movable section's pivot point 38*a*, so that the perpendicular dimension D from the pivot point 38*a* to the lower lip 45 is no greater than the perpendicular dimension D′ from that pivot point 38*a* to the horizontal bottom edge 33*b* of the fixed section 33. Such a dimensional relationship permits the entire mouth opening M of the machine to be exposed to the cloth stack 15 when the guard is full open as shown in FIG. 3.

Note also the notch 49 defined in the upper edge 47 of the movable section 37 between the upper lip 44 and the U-shaped nose 42. This notch 49 is configured to cooperate with the notch 27*a* provided in the fixed section particularly when the movable section is in the full open position as shown in FIG. 4. This notch 49 is adapted to accommodate the grinding wheels 27 of the sharpener device 26 when same are in sharpening relation with the circular blade 11, and when the movable section is full open.

An auxiliary section 52 in the nature of a heel is fixed to the mounting structure for the sharpening device 26. The auxiliary section 52, when the sharpener device 26 is retracted out of the sharpening attitude with the blade, is adapted to overlie or cover the notch 27*a* cut in the fixed section, see FIG. 2. This coverage of the notch 27*a* by the auxiliary section 52, of course, closes the peripheral edge 31 of the circular blade 11 to accidental finger contact through the notch 27*a*. The auxiliary section 52 is located in a plane which is parallel to, but not coplanar with, the main planar portion 53 of the movable section 38. The auxiliary section 52 is positioned outside of the movable section's planar portion 53 relative to the circular blade 11, i.e., that portion 53 is disposed between the planes of the auxiliary section and the circular blade. Further, and importantly, the dimensional configuration of the auxiliary section 52 (and, also the length of the upper lip 44) are such that the auxiliary section's top edge 54 does not contact the front edge 55 of the upper lip 44 when the sharpening device 26 is in sharpening contact with the blade's edge 31 whether the guard's movable section 38 is fully open (FIG. 4) or fully closed (FIG. 2) thereby permitting the blade to be sharpened whether the guard 32 is open or closed.

Since the guard's movable section 38 is pivotally mounted to the fixed section 33, and since the fixed section 33 is retained in operational relation with the machine 10 (by means of fastening means characterized by foot 34 being seated in the machine base's well 34*a*, and by means of fastening means characterized by thumb screw 35 threaded into the machine standard's tapped hole 36), it will be apparent that the safety guard 32 can be easily and simply removed from operational relation with the machine to permit changing of the circular blade 11 when desired by an operator. This for the reason that, by removing the fixed section 32 from mounted relation with the machine's standard 19, such allows the blade 11 to be pulled off its drive shaft, not shown, since substantially the entire peripheral edge of the blade will be exposed by removing the guard 32.

In use, and when it is desired to open the movable section so as to define the mouth M which will make the circular blade accessible to the cloth stack, the thumb of the operator's hand which grips handle 22 is used to pivot the movable section 38 clockwise (as shown in the FIGURES) by depressing upper lip 44 adjacent end 46 of that movable section. The size of the mouth opening M may be as desired by the operator, the clockwise limit of the movable section being defined by abutment of the top edge 56 of the U-shaped nose 42 against sharpening wheels 27. Once the movable section 38 has been opened to the FIG. 3 attitude, and the cutting of the cloth stack 15 begun, the operator may release thumb pressure on the upper lip 44 of the movable section 37, thereby permitting the movable section's chin 43 to ride on top of the cloth stack. Because of the slight curvature of the chin, ripples and the like do not form in the upper layers of the cloth stack 15. Once cutting of the cloth stack is accomplished, and once the cloth is removed from operational relation with the cloth cutting machine, the safety guard's movable section 38 drops by gravity into its home or rest position shown in FIG. 2 from the operational or cutting position shown in FIG. 3 due to the relative heavy weight of the U-shaped nose 42 end compared to the relatively light weight of the rear end 46 of that movable section.

The notch 27*a* in the fixed section's outer periphery, when the movable section 38 is in the fully closed position shown in FIG. 2 as well as when the movable section is in the fully open position shown in FIG. 3, exposes a segment of the circular blade's peripheral edge 31 to the sharpening stones 27 of the sharpener device 26. Further, and importantly, the corresponding notch 49 in the movable section's top edge 47 is configured relative to the notch 27*a* in the fixed section so that the sharpener device 26 may be operated whether the movable section is fully opened or fully closed. This, of course, permits the round knife blade 11 to be sharpened whether the cloth cutting machine is removed from operational relation with a cloth stack 15 or whether it is in the midst of a cutting pattern when in operational relation with a cloth stack. The sharpener device's auxiliary section 52 is configured and sized, relative to the movable section's top lip 44, so that same does not contact the movable section when the sharpening device is being used.

Having described in detail the preferred embodiment of my invention, what I desire to claim and protect by Letters Patent is:

1. A simplified safety guard for a cloth cutting machine of the vertically oriented circular blade type, said machine including a base and a standard fixed to said base, said standard having said blade rotatably mounted thereon in a vertical plane, and said standard mounting a handle that extends generally rearwardly of said blade, said safety guard comprising a fixed guard section removably mounted to said machine's standard, said fixed section protecting substantially three quarters of said circular blade's periphery from about the 9 o'clock position through the 12 o'clock position to the 6 o'clock position relative to the machine's right-to-left direction of travel, a movable guard section pivotally connected to said fixed section for selectively protecting the fourth quarter of said circular blade's periphery, said pivotal connection being positioned within the 12 o'clock through 3 o'clock quadrant of said circular blade relative to the machine's right-to-left direction of travel, said movable section being fabricated of a single integral structural element of a transparent material to permit viewing of the cutting pattern on a cloth stack adapted to be cut by said machine, said movable section being structured so that said entire single element structure is positioned above a phantom diameter line of said circular blade disposed parallel to said machine's base when said movable section is fully opened, and said movable section including a. a U-shaped nose at the front end thereof adapted to embrace said blade's edge in the fourth quarter of said circular blade's periphery when said movable section is in the home position, and b. a thumb lip adjacent the machine's handle at the rear end of said movable section for use by the machine's operator to open the movable section when desired, and fastening means adapted to mount said fixed section to said machine, said fastening means being operable to allow removal of said fixed section from operative engagement with said machine, removal of said fixed section from said machine effecting removal of said simplified safety guard to allow changing of said circular blade.

2. A simplified safety guard as set forth in claim 1 including structure defining a notch along the top edge of said fixed section, said fixed section notch being oriented to permit engagement of a blade sharpener device with said circular blade in a sharpening relationship, and structure defining a notch along the top edge of said movable section, said movable section notch being configured to permit engagement of a blade sharpener device with the circular blade whether said movable section is fully opened or fully closed.

3. A simplified safety guard as set forth in claim 1 including a lower lip extending outward from said movable section along the bottom edge thereof, said lower lip defining the lower edge of said movable section, said lower lip being positioned so that same is disposed above said phantom diameter line when said movable section is fully opened.

4. A safety guard for a cloth cutting machine as set forth in claim 1, said fastening means including structure for connecting said guard to said machine's base and to said standard, said structure including a foot fixed to said fixed section and adapted to seat in a well defined in said base, said structure also including a fastening device adapted to hold said fixed section to said standard, said guard being removable from said machine simply by releasing said fastening device and lifting said foot out of said well.

5. A safety guard for a cloth cutting machine as set forth in claim 2, including an auxiliary guard section fixed to said blade sharpener device, said auxiliary section being sized to overlie said fixed section notch when said sharpener device is moved out of sharpening contact with said blade and when said movable section is in the home position.

6. A simplified safety guard for a cloth cutting machine of the vertically oriented circular blade type, said machine including a base and a standard fixed to said base, said standard having said blade rotatably mounted thereon in a vertical plane, and said standard mounting a handle that extends generally rearwardly of said blade, said safety guard comprising a fixed guard section removably mounted to said machine's standard, said fixed section protecting substantially three quarters of said circular blade's periphery from about the 9 o'clock position through the 12 o'clock position to the 6 o'clock position relative to the machine's right-to-left direction of travel, structure defining a notch along the top edge of said fixed section, said fixed section notch being located in the 9 o'clock through 12 o'clock quadrant of said circular blade relative to the machine's right-to-left direction of travel to permit engagement of a blade sharpener device with said circular blade in a sharpening relationship, a movable guard section pivotally connected to said fixed section for selectively protecting the fourth quarter of said circular blade's periphery, said movable section being fabricated of a single integral structural element of a transparent material to permit viewing of the cutting pattern on a cloth stack adapted to be cut by said machine, said movable section being structured so that said entire single element structure is positioned above a phantom diameter line of said circular blade disposed parallel to said machine's base when said movable section is fully opened, structure defining a notch along the top edge of said movable section, said movable section notch being configured to permit engagement of a blade sharpener device with said circular blade whether said movable section is fully closed or fully opened, a thumb lip on said movable section adjacent the machine's handle for use by the machine's operator to open the movable section when desired, and fastening means adapted to mount said fixed section to said machine, said fastening means being operable to allow removal of said fixed section from operative engagement with said machine, removal of said fixed section from said machine effecting removal of said simplified safety guard to allow changing of said circular blade.

7. A simplified safety guard as set forth in claim 6 including a U-shaped nose at the front end of said movable section, said nose being adapted to embrace said blade's edge in the fourth quarter of said circular blade's periphery when said movable section is in the fully closed position.

8. A simplified safety guard as set forth in claim 6 including a lower lip extending outward from said movable section along the bottom edge thereof, said lower lip defining the lower edge of said movable section, said lower lip being positioned so that same is disposed above said phantom diameter line when said movable section is fully opened.

9. A safety guard for a cloth cutting machine as set forth in claim 6, said fastening means including structure for connecting said guard to said machine's base and to said standard, said structure including a foot fixed to said fixed section and adapted to seat in a well defined in said base, said structure also including a fastening device adapted to hold said fixed section to said standard, said guard being removable from said machine simply by releasing said fastening device and lifting said foot out of said well.

10. A safety guard for a cloth cutting machine as set forth in claim 6, including an auxiliary guard section fixed to said blade sharpener device, said auxiliary section being sized to overlie said fixed section notch when said sharpener device is moved out of sharpening contact with said blade and when said movable section is in the fully closed position.

* * * * *